United States Patent [19]

Svoboda

[11] Patent Number: 4,500,106

[45] Date of Patent: Feb. 19, 1985

[54] SKI BRAKE

[75] Inventor: Josef Svoboda, Schwechat, Austria

[73] Assignee: TMC Corporation, Baar, Switzerland

[21] Appl. No.: 363,741

[22] Filed: Mar. 30, 1982

[30] Foreign Application Priority Data

Apr. 1, 1981 [AT] Austria ..... 1510/81

[51] Int. Cl.[3] ..... A63C 7/10

[52] U.S. Cl. ..... 280/605; 280/633

[58] Field of Search ..... 280/605, 636, 626, 633, 280/632

[56] References Cited

U.S. PATENT DOCUMENTS 4,226,439 10/1980 Kirsch ..... 280/636

FOREIGN PATENT DOCUMENTS 3035738 5/1981 Fed. Rep. of Germany ..... 280/605

597880 4/1978 Switzerland .

*Primary Examiner*—Joseph F. Peters, Jr.

*Assistant Examiner*—Joseph G. McCarthy

*Attorney, Agent, or Firm*—Flynn, Thiel, Boutell & Tanis

[57] ABSTRACT

A heel holder of a ski binding is mounted on a guide plate which is in turn supported on a ski for movement longitudinally thereof. A biasing mechanism yieldably urges the guide plate forwardly with respect to the ski. A ski brake mounted on the ski just ahead of the heel holder includes a pedal which is supported for pivotal movement and two braking mandrels operatively coupled to the pedal, pivotal movement of the pedal effecting movement of the braking bars between a braking and a retracted position. An inclined surface is provided on either the free end of the pedal or the forward end of the guide plate, and at least one roller engageable with the inclined surface is provided on the other of the pedal and guide plate. The biasing mechanism, through engagement of the roller and inclined surface, urges the pedal and braking mandrels toward the braking position. When a ski shoe is releasably secured in the heel holder, a small space preferably exists between the roller and the inclined surface.

14 Claims, 6 Drawing Figures

SKI BRAKE

FIELD OF THE INVENTION

This invention relates to a ski brake.

BACKGROUND OF THE INVENTION

A ski brake includes a braking bar which has two braking mandrels, is made of a bent wire material having several sections, and can be pivoted by means of a pedal against the force of a spring about an axis which extends substantially at a right angle with respect to the longitudinal axis of the ski from a braking position in which the two braking mandrels project below the running surface of the ski to a retracted position in which the braking mandrels lie substantially above the upper side of the ski. The pedal is supported for pivotal movement about an axis which extends substantially at a right angle with respect to the longitudinal axis of the ski. The braking bar or its pedal is biased for pivotal movement from the braking position toward the retracted position. A ski binding part is arranged on a guide plate or the like which is movably supported on a ski-fixed guide rail and, during a stepping in with a ski shoe, can be moved away from the pivot axis of the ski brake against the force of at least one spring. The spring is part of a thrust-balancing mechanism and can urge the pedal toward the retracted position. The end surface of the pedal which faces the ski binding part cooperates with a congruent end surface of the guide plate or the like of the ski binding part, these two cooperating end surfaces preferably being sloped or beveled.

One goal of the present invention is to improve the above-mentioned type of ski brake so that stepping into the binding is easier.

A further goal of the invention is to improve the above-mentioned type of ski brake so that external influences, such as bending of the ski during use, do not cause erecting forces to be exerted on the ski brake.

SUMMARY OF THE INVENTION

These purposes are attained inventively by providing, either on the pedal of the ski brake or on the guide plate of the ski binding, at least one roller which engages a sloped or beveled end of the other of said structural parts.

This inventive measure produces, in response to relative movement between the sloped or beveled ends of the pedal of the ski brake and the guide plate of the ski binding, only friction which is characteristic of rolling movement and which is less than friction caused by sliding movement.

In a particularly advantageous embodiment, the roller is spaced slightly from the associated beveled surface when a ski boot is releasably secured in the binding and the ski brake is in the retracted position.

It has proven particularly advantageous if the roller is arranged on the pedal so that its circumferential surface is tangential to the underside of the pedal. In this manner, the absence of engagement between the sloped or beveled ends of the pedal and the guide plate is always assured.

In a further development of the inventive thought, it is provided that the underside of the pedal transfers into the sloped or beveled pedal end surface through a rounded portion. Through this, any kind of tilting of the pedal on the guide plate in the area of the roller is to be avoided.

According to a further characteristic of the invention, the roller is provided on the guide plate of the ski binding and, viewed in elevational direction, is arranged approximately in the plane of symmetry of the guide plate, a vertical distance existing between the circumferential surface of the roller and the upper side of the guide plate which is preselected to effect proper support of the pedal on the roller in an operational position. The underside of the pedal again preferably transfers into the sloped or beveled end surface through a rounded portion. Through this inventive measure, the pedal of the ski brake is always supported in its braking position on the roller so that, during a stepping in by the ski shoe or a sole plate, the low friction rolling movement starts immediately. Thus, in the first phase of the stepping in, it is not possible for a sliding movement and thus sliding friction to occur.

Two rollers are preferably provided which are arranged symmetrically on the two sides of the pedal or the guide plate in relationship to the longitudinal axis of the ski.

BRIEF DESCRIPTION OF THE DRAWINGS

Two exemplary embodiments of the invention are illustrated in the drawings, in which.

DETAILED DESCRIPTION

Figure 1:
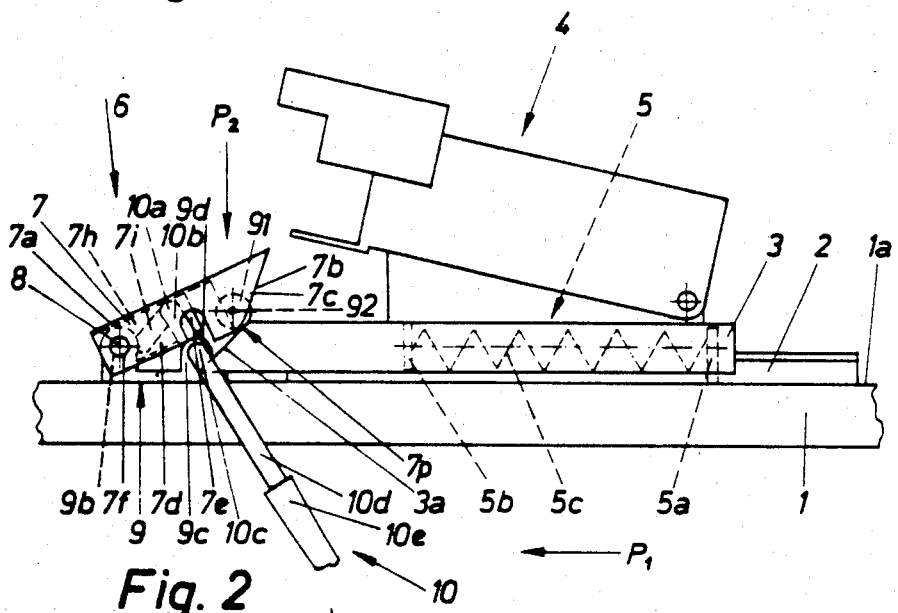
FIG. 1 is an elevational side view of a combination ski binding and ski brake mechanism embodying the present invention in the braking position.
Figure 2:
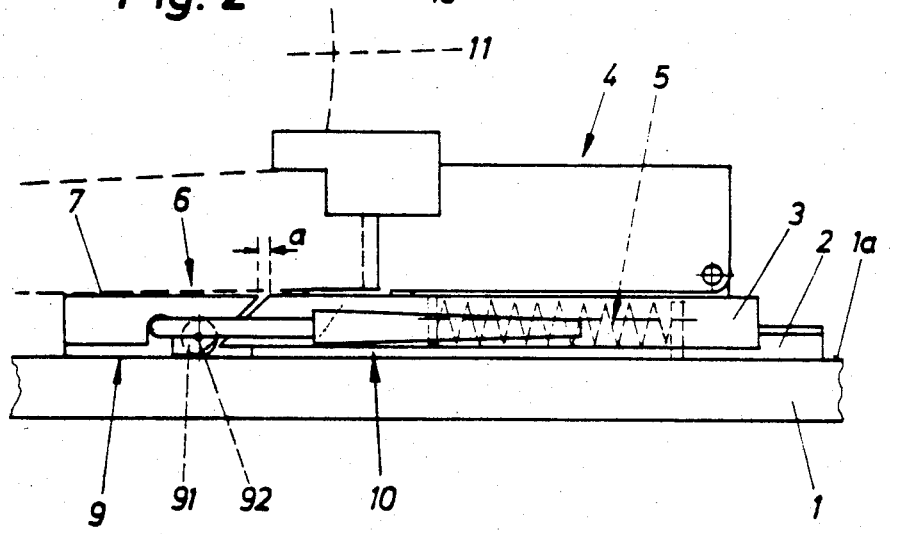
FIG. 2 is a side view similar to FIG. 1 but showing the ski binding and ski brake mechanism in a retracted position.
Figure 3:
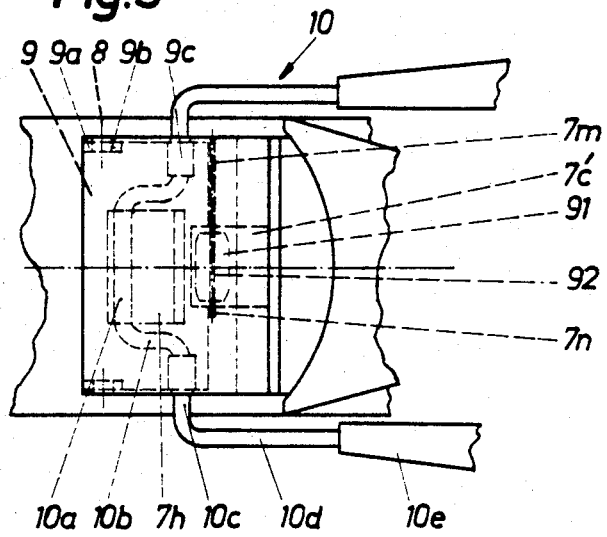
FIG. 3 is a fragmentary top view of the mechanism of FIG. 2.

As can be recognized from the first exemplary embodiment according to FIGS. 1 to 3, a ski 1 is provided, on the upper side 1*a* of which is secured a guide rail 2. The guide rail 2 is preferably screwed onto the ski 1 in a conventional manner by screws which are not illustrated. The guide rail 2 serves to slidably support a guide plate 3 for a conventional ski binding 4 in a conventional manner for movement longitudinally of the ski. The ski binding 4 and guide plate 3 are urged in the direction of the arrow $P_1$, namely toward the front tip of the ski, by a thrust-balancing mechanism 5 which includes a ski-fixed holding part 5*a*, a binding-fixed holding part 5*b* and a compression spring 5*c* which has its ends disposed against the holding parts 5*a* and 5*b*. The end of the guide plate 3, which end faces the tip of the ski, has a beveled surface 3*a*. The beveled surface 3*a* is arranged at an acute angle with respect to the upper side 1*a* of the ski 1 and rises in a direction toward the rear end of the ski. A ski brake 6 which includes a pedal 7 is supported on the guide rail 2 in a manner which will yet be described in greater detail a small distance from the ski binding 4. A beveled surface 7*b* is provided on the pedal 7 and is preferably constructed so as to be parallel to the beveled surface 3*a* of the guide plate 3 when the brake is in the retracted position. The beveled surface 3*a* can, starting from the retracted position of the ski brake 6 illustrated in FIG. 3 and with no ski shoe secured in the ski binding 4, engage a pedal 7 of the ski brake 6 and urge it toward the braking position illustrated in FIG. 1. The guide plate 3 is biased by the thrust-balancing mechanism 5, which urges the guide plate 3 in the direction of the arrow $P_1$ into engagement with the ski brake 6 when no ski boot is secured in the binding 4. In the area of the beveled surface 7*b* the pedal 7 in the present exemplary embodiment is preferably constructed as a solid part 7*c*. The remainder of the pedal 7 is preferably manufactured of a thin material of generally constant thickness. The pedal 7 has, starting from its upper side 7*a* and parallel to the longitudinal axis of the ski 1, a side part 7*d* on each side thereof which is positioned vertical with respect to the upper side 1*a* of the ski 1. The two side parts 7*d* are bent portions of the material of the upper side 7*a* of the pedal 7 and are approximately normal thereto. The height of the portion of the side parts 7*d* adjacent the solid part 7*c* corresponds with the height of the pedal in the area of the solid part 7*c*. The portion of the side parts 7*d* remote from the solid part 7*c* is of lesser height, the lower edge thereof being offset upwardly in order to assure a satisfactory swinging of the pedal 7 from the braking position of the ski brake 6 to the retracted position, and vice versa. The side parts 7*d* each have, in the area thereof adjacent the solid part 7*c*, a recess 7*e* which receives, when the pedal 7 is in the retracted position, a braking bar 10. The full part 7*c* at this time engages the upper side of the ski 1 and thus serves as a stop to limit movement of the pedal 7.

The side parts 7*d* of the pedal 7 each have in the area of their end nearest the tip of the ski a hole 7*f* which extends at a right angle to the longitudinal axis of the ski 1. The two holes 7*f* are aligned and pivotally support the pedal 7 by means of two bearing axles 8 and a support plate 9 which will be described in greater detail later and is fixedly connected to the guide rail 2. The pedal 7 thereby grips slightly over the support plate 9. The pedal 7 also carries on the underside of its upper side 7*a*, symmetrically with respect to the longitudinal axis of the ski 1, a guide block 7*h* having a slot 7*i* therein which extends through the block 7*h* at a right angle with respect to the longitudinal axis of the ski 1. The slot 7*i* is arranged in the guide block 7*h* at an inclination so that its end adjacent the full part 7*c* is, in the retracted position of the ski brake, further from the upper side 1*a* of the ski 1 than its other end. A connecting section 10*a* of a braking bar 10 is guidedly received in the slot 7*i*, which braking bar will be described in greater detail hereinafter. The guide block 7*h* is preferably designed as two pieces for installation purposes, and the two pieces of the guide block 7*h*, which are not identified in detail in the drawings, could for example be screwed together.

The support plate 9 carries, in the area of its end which faces the tip of the ski and on each side thereof, as can best be seen in FIG. 3, a bearing flange 9*a* which is positioned normal to the upper side 1*a* of the ski 1. The bearing flanges 9*a* preferably end flush with the end of the support plate 9 which is closest to the tip of the ski. A hole 9*b* which extends at a right angle to the longitudinal axis of the ski 1 is provided near the end of each bearing flange 9*a*. Furthermore, this end of the bearing flanges 9*a* is preferably rounded in a manner concentric with the hole 9*b*. The support plate 9 carries at its opposite end and on each side a bearing member 9*c*. The bearing members 9*c* end flush with the associated sides of the support plate and extend part of the way toward the longitudinal axis of the ski 1. The bearing members 9*c* have bearing holes 9*d* which extend at a right angle with respect to the longitudinal axis of the ski 1.

The braking bar 10 is supported for limited pivotal movement in the bearing holes 9*d* by means of bearing sections 10*c*. The bearing sections 10*c* lie parallel to the connecting section 10*a*, and the sections 10*a* and 10*c* are positioned approximately at a right angle to the longitudinal axis of the ski 1. The connecting section 10*a* lies, in a direction toward the tip of the ski, in front of the two bearing sections 10*c*, the sections 10*c* being connected to the section 10*a* by respective sections 10*b* which are arranged parallel to the longitudinal axis of the ski 1. The bar 10 includes braking mandrels 10*d* which in FIG. 2 point toward the end of the ski and are connected at a right angle to the respective bearing sections 10*c*. The braking mandrels 10*d* have at their free ends, in a conventional manner, plastic coatings 10*e*.

A roller 91 is illustrated in the drawings and is described in greater detail hereinafter. If the roller 91 were not present, the illustrated mechanism would operate in the following manner.

If a force were to act in the direction of an arrow $P_2$ (FIG. 1) onto only the pedal 7 of the ski brake 6, then it would pivot in a clockwise direction in FIG. 1 about the two bearing axles 8. The beveled surface 7*b* of the pedal 7 would thereby slidably engage the beveled surface 3*a* of the guide plate 3 and move the guide plate 3, against the urging of the spring 5*c* of the thrust-balancing mechanism 5, toward the rear end of the ski. The connecting part 10*a* of the braking bar 10 would slide in the slot 7*i* of the guide block 7*h* of the pedal 7 to its end nearest the tip of the ski and thereby pivot the braking bar 10 and swing the braking mandrels 10*d* into the retracted position of FIG. 2. As soon as the full part 7*c* of the pedal 7 engaged the upper side 1*a* of the ski 1, the swivelling movement of the ski brake 6 would end, the ski brake 6 then being in the retracted position.

When a ski shoe 11 of a skier is inserted into the ski binding 4, then the binding is moved, against the force of the spring 5*c*, toward the rear end of the ski. Furthermore, a force in the direction of the arrow $P_2$ is simultaneously applied onto the pedal 7 by the shoe, causing the ski brake 6 to swing into its retracted position in the manner described above.

In order that, in spite of external influences on the ski 1 causing movement of the binding 4 relative to the ski 1, for example bending of the ski during use, no erecting movement whatsoever of the ski brake 6 occurs, there is provided in the downhill skiing position of the ski brake 6 and ski binding 4 when the ski shoe 11 is engaged in the binding 4 a gap "a" (FIG. 2). Thus, sufficient clearance exists in order to permit the ski binding 4, during bending of the ski, to carry out a thrust-balancing movement, namely a movement in the direction of the longitudinal of the ski 1, without the beveled area 3*a* of the guide plate 3 engaging the associated surface of the pedal 7 of the ski brake 6 and thus starting an undesired pivotal movement of the ski brake.

When the ski shoe 11 is released from the ski binding 4, the thrust-balancing mechanism 5 will move the ski binding 4 toward the tip of the ski. The beveled surface 3*a* of the guide plate 3 will engage the beveled surface 7*b* of the pedal 7 and cause the pedal 7 to pivot counterclockwise so that the braking bar 10 assumes the braking position according to FIG. 1.

As can best be seen from FIG. 3, the roller 91 is arranged rotatably on an axle 92 which is supported in the solid part *7c* of the pedal 7. The solid part *7c* of the pedal 7 has a recess *7'c* for this purpose symmetrically arranged in relationship to the longitudinal axis of the ski. The axis 92 is supported in a hole *7m* which is provided in a part of the solid part *7c* of the pedal 7 on one side of the recess *7'c* and is in alignment with another hole *7n* which is a blind hole and is provided in the solid part *7c* of the pedal 7 on the other side of the recess *7'c*. In this manner, it is easy to carry out installation or, if necessary, removal of the roller 91.

The arrangement of the roller 91 on the pedal 7 is furthermore such that the circumferential surface of the roller 91 is tangential to the lower edge of the side parts *7d* of the pedal 7 adjacent the solid part *7c*. This arrangement assures that the roller 91, rather than the surface *7b*, will come into engagement with the beveled surface *3a* of the guide plate 3 during operation, thereby assuring a rolling cooperation and not a sliding cooperation between the pedal 7 and the base plate 3. Accordingly, rolling and not sliding frictional forces are always involved. Furthermore, the danger of canting or wedging is avoided.

Also, it is provided that the lower end of the solid part *7c* of the pedal 7 transfers into the underside of the pedal 7 defined by the lower edges of the two side parts *7d* through a rounded portion *7p* (FIG. 1) which also serves to prevent an unintended canting.

When a ski shoe is releasably secured in the binding 4, the roller 91 is spaced from the inclined surface *3a* of the guide plate 3, as shown in FIG. 2, thereby allowing the guide plate 3 and binding 4 to move relative to the ski, for example in response to bending thereof, without exerting erecting forces on the ski brake.

Figure 6:
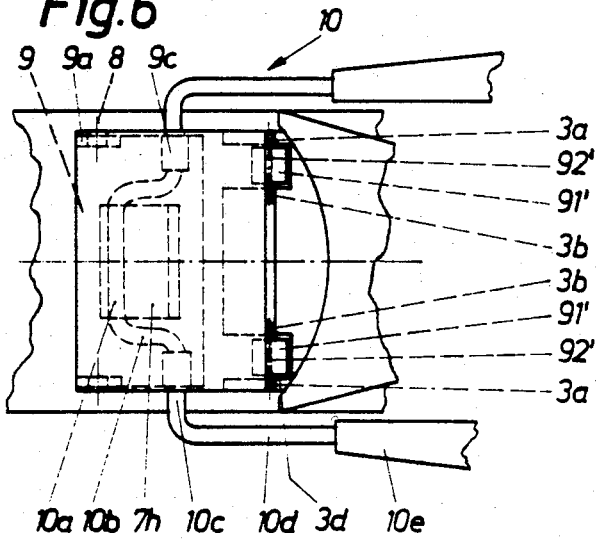
FIG. 6 is a fragmentary top view similar to FIG. 3 of the second embodiment.
Figure 4:
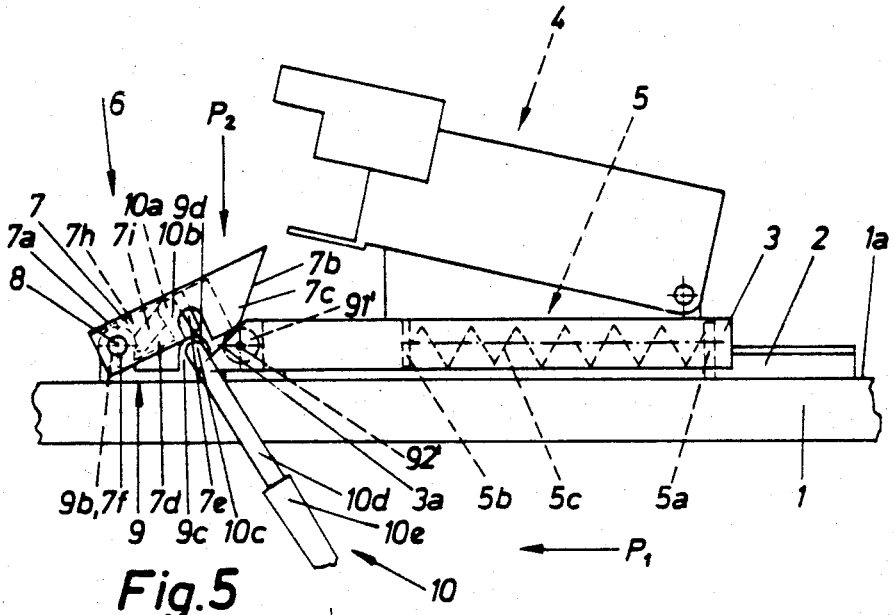
FIG. 4 is a side view similar to FIG. 1 of a second embodiment of the ski binding and ski brake mechanism.
Figure 5:
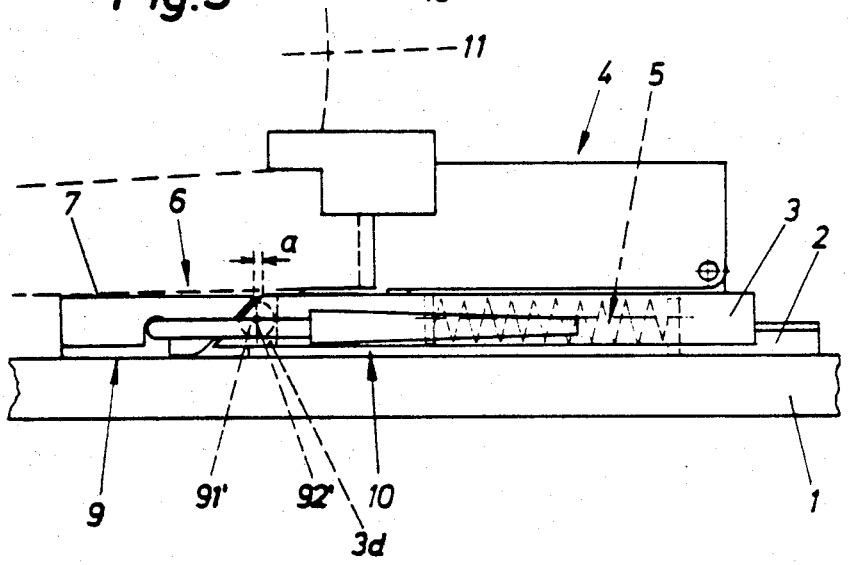
FIG. 5 is a side view similar to FIG. 2 of the second embodiment.

In the second embodiment according to FIGS. 4 to 6, the design of the ski brake 6, the ski binding 4 and the thrust-balancing mechanism 5 corresponds substantially with that described above. The primary difference is the arrangement and number of rollers. Here, two rollers 91' are provided which are each supported rotatably on an axle 92', which axles 92' are in turn supported in the guide plate 3. The two axles 92' each are received in holes *3a* and *3b*, the latter being a blind hole. Thus, a respective through-going hole *3a* and a respective blind hole *3b* are provided for each axle 92'.

The positioning of the two rollers 91' in the guide plate 3 of the ski binding 4 is such that the beveled surface *7b* of the pedal 7 can engage the circumferential surface of the rollers 91' during operation in a manner avoiding contact between the surfaces *7b* and *3a*. The solid part *7c* again transfers into the underside of the pedal 7 defined by the lower edges of the two side parts *7d* through a rounded portion. The two rollers 91' are disposed in recesses *3d* provided in the guide plate 3.

The invention is not limited to the illustrated exemplary embodiments. Further modifications and variations, including the rearrangement of parts, are possible without leaving the scope of protection of the invention. In particular, there exists no limitation with respect to the design of the pedal. It can consist in its entirety of a plastic or cast material or can be made of a sheet-metal material. Also, the arrangement and guiding of the braking bar in the pedal is not limited to the described arrangement.

It is also conceivable to reverse the illustrated arrangement of the rollers, namely, to arrange a single roller on the guide plate of the ski binding or to arrange two rollers on the pedal. Accordingly, two recesses would have to be provided in the solid part of the pedal and one support in the center area of the pedal.

A further modification could consist in supporting, as it is known, each roller on a split axle, the two parts of which are movable relative to one another against a spring force. It is then sufficient to provide for the support of each axle two blind holes, which increases the strength of the pedal. For this, blind holes with a small diameter are sufficient. Such axles are well known, for example for window blinds or for rolls of toilet paper. Thus, a further description of the structure of such split axles should not be needed for the average man skilled in the art.

The circumferential surface of the rollers can, if desired, by roughened or provided with grooves, which improves the grip of the roller on the cooperating inclined surface as compared with rollers with a smooth circumferential surface but at the burden of friction, which is slightly increased in such a case.

The embodiments of the invention in which an exclusive property or privilege is claimed are defined as follows:

1. A ski brake, comprising a braking bar which is supported for pivotal movement about a first axis extending approximately perpendicular to the longitudinal axis of the ski, has two braking mandrels, is made of a bent wire material, and can be pivoted about said first axis by a pedal between a braking position in which the two braking mandrels project below the running surface of the ski and a retracted position in which the braking mandrels lie substantially above the upper side of the ski, said pedal being supported for pivotal movement about a second axis which extends at approximately a right angle with respect to the longitudinal axiis of the ski and being supported on the ski at a location spaced a small distance from a ski binding part, said ski binding part including a guide plate which is longitudinally movably supported on a guide rail secured to the ski, said guide plate being movably along said guide rail in a direction away from said first axis against the force of resilient thrust-blancing means which includes at least one spring, said pedal having an end which is spaced from said second axis and faces an end of said ski binding part, and including a roller supported on one of said end of said pedal and said end of said ski binding part for rotation about a transverse horizontal axis, said roller being operatively engageable with a surface which is provided on the other of said end of said pedal and said end of said ski binding part and which is inclined upwardly in a direction toward said ski binding part; wherein said roller is provided on said pedal and has its circumferential surface tangential to the underside of said pedal.

2. The ski brake according to claim 1, wherein the underside of said pedal transfers into an inclined surface thereon through a rounded surface portion.

3. A ski brake, comprising a braking bar which is supported for pivotal movement about a first axis extending approximately perpendicular to the longitudinal axis of the ski, has two braking mandrels, is made of a bent wire material, and can be pivoted about said first axis by a pedal between a braking position in which the two braking mandrels project below the running surface of the ski and a retracted position in which the braking mandrels lie substantially above the upper side of the ski, said pedal being supported for pivotal movement about a second axis which extends at approximately a right angle with respect to the longitudinal axis of the ski and being supported on the ski at a location spaced a small distance from a ski binding part, said ski binding part including a guide plate which is longitudinally movably supported on a guide rail secured to the ski, said guide plate being movable along said guide rail in a direction away from said first axis against the force of resilient thrust-balancing means which inclides at least one spring, said pedal having an end which is spaced from said second axis and faces an end of said ski binding part, and including a roller supported on one of said end of said pedal and said end of said ski binding part for rotation about a transverse horizontal axis, said roller being operatively engageable with a surface which is provided on the other of said end of said pedal and said end of said ski binding part and which is inclined upwardly in a direction toward said ski binding part; wherein said roller is provided on said ski binding part and is approximately bisected by a vertically and longitudinally extending plane of symmetry of said guide plate, wherein the upwardly facing portion of the circumferential surface of said roller is spaced vertically below the upper side of said guide plate, wherein said inclined surface is provided on said end of said pedal, and wherein the underside of said pedal transfers into said inclined surface thereon through a rounded surface portion.

4. A ski brake, comprising a braking bar which is supported for pivotal movement about a first axis extending approximately perpendicular to the longitudinal axis of the ski, has two braking mandrels, is made of a bent wire material, and can be pivoted about said first axis by a pedal between a braking position in which the two braking mandrels project below the running surface of the ski and a retracted position in which the braking mandrels lie substantially above the upper side of the ski, said pedal being supported for pivotal movement about a second axis which extends at approximately a right angle with respect to the longitudinal axis of the ski and being supported on the ski at a location spaced a small distance from a ski binding part, said ski binding part including a guide plate which is longitudinally movably supported on a guide rail secured to the ski, said guide plate being movable along said guide rail in a direction away from said first axis against the force of resilient thrust-balancing means which includes at least one spring, said pedal having an end which is spaced from said second axis and faces an end of said ski binding part, and including a roller supported on one of said end of said pedal and said end of said ski binding part for rotation about a transverse horizontal axis, said roller being operatively engageable with a surface which is provided on the other of said end of said pedal and said end of said ski binding part and which is inclined upwardly in a direction toward said ski binding part; including two said rollers which, in relationship to the longitudinal axis of the ski, are arranged symmetrically on said one of said end of said pedal and said end of said ski binding part.

5. The ski brake according to claim 1 or claim 3, wherein said roller is spaced from said inclined surface when a ski shoe is releasably secured in said ski binding part.

6. A ski brake adapted to be mounted on a ski, comprising: a pedal supported for pivotal movement about a transverse horizontal first axis between a retracted position adjacent and generally parallel to the ski and a braking position extending upwardly at an angle to the ski, said pedal having an end portion which is spaced from said first axis; a movably supported braking mandrel which is operatively coupled to and moves in response to pivotal movement of said pedal, said braking mandrel projecting below an undersurface of the ski when said pedal is in said braking position and being disposed above an upper surface of the ski when said pedal is in said retracted position; a guide member supported for movement toward and away from said pedal longitudinally of the ski, said guide member being adapted to have a ski binding part mounted thereon and having an end portion which is adjacent said end portion of said pedal when said pedal is in said retracted position; resilient means for yieldably urging said guide member longitudinally of the ski in a first direction toward said pedal; means defining an inclined surface on said end portion of one of said pedal and said guide member, said inclined surface extending upwardly and in a second direction opposite said first direction; and a roller supported on said end portion of the other of said pedal and said guide member for rotation about a second axis which is substantially parallel to said first axis, said roller being engageable with said inclined surface on said one of said pedal and said guide member; wherein during movement of said guide member in said first direction under the urging of said resilient means, engagement of said roller and said inclined surface causes said pedal to be moved from said retracted position toward said braking position.

7. The ski brake according to claim 6, including means defining a recess in said end portion of said other of said pedal and said guide member, said roller being disposed in said recess.

8. The ski brake according to claim 7, wherein said roller is supported on said end portion of said pedal and said inclined surface is provided on said end portion of said guide member.

9. The ski brake according to claim 8, wherein a circumferential surface of said roller is tangential to an undersurface of said pedal.

10. The ski brake according to claim 7, wherein said roller is rotatably supported on said end portion of said guide member and said inclined surface is provided on said end portion of said pedal.

11. The ski brake according to claim 10, including means defining a further recess in said end portion of said guide member, and including a further roller substantially disposed in said further recess and supported for rotation about said second axis.

12. The ski brake according to claim 6, wherein when said pedal is in said retracted position and a binding part is mounted on said guide member and is releasably securing a ski boot on the ski, said pedal and said guide member are spaced from each other, and said roller and said inclined surface are spaced from each other.

13. The ski brake according to claim 6, including a braking bar supported for pivotal movement about a third axis which is parallel to and spaced in said second direction from said first axis, said braking bar having a section which is said braking mandrel, said pedal having coupling means for effecting pivotal movement of said braking bar in response to pivotal movement of said pedal.

14. The ski brake according to claim 13, wherein said coupling means includes means defining an elongate slot in a portion of said pedal, said braking bar having a section which is slidably received in said slot in said pedal.

* * * * *